US005314027A

United States Patent [19]

Wood

[11] Patent Number: 5,314,027

[45] Date of Patent: May 24, 1994

[54] FIRE SUPPRESSION SYSTEM FOR A DOUBLE WALLED STORAGE TANK

[76] Inventor: Donald A. Wood, 2651 S. Cherokee St., Denver, Colo. 80223

[21] Appl. No.: 16,857

[22] Filed: Feb. 12, 1993

[51] Int. Cl.[5] ..... A62C 37/11

[52] U.S. Cl. ..... 169/60; 169/61; 169/68; 220/88.1; 220/425; 220/428; 220/565

[58] Field of Search ..... 169/13, 48, 49, 60, 169/61, 66, 68; 220/88.1, 425, 428, 454, 455, 565

[56] References Cited

U.S. PATENT DOCUMENTS

| | | | |
|---|---|---|---|
| 1,874,243 | 8/1932 | Clark | 169/60 |
| 2,687,618 | 8/1954 | Bergstrom | 62/48.1 |
| 3,019,843 | 2/1962 | Powell | 169/56 |
| 3,896,881 | 7/1975 | De Boer | 169/66 |
| 4,023,621 | 5/1977 | Olson | 169/68 |
| 4,177,863 | 12/1979 | Simon | 169/62 |
| 4,756,447 | 7/1988 | Gerhard | 220/469 |
| 4,993,497 | 2/1991 | Majors | 169/66 |
| 5,012,949 | 5/1991 | McGarvey et al. | 220/455 |

FOREIGN PATENT DOCUMENTS 2000022 1/1979 United Kingdom .

*Primary Examiner*—David M. Mitchell
*Assistant Examiner*—Andrew C. Pike
*Attorney, Agent, or Firm*—Dorr, Carson, Sloan & Peterson

[57] ABSTRACT

A fire suppression system for a double walled storage tank having an inner tank for containing a flammable liquid and an outer tank separated from the inner tank by a defined space. A leakage detector monitors any leakage of the flammable liquid from the inner tank into the space. A temperature sensor triggers a flow of coolant into the space in the event combustion of the flammable liquid is detected. If no leakage of flammable liquid has been previously detected, the flow of coolant exits the space and is sprayed on the outer surface of the outer tank. If leakage has been detected, the coolant and any entrained flammable liquid are safely diverted to a remote location. In the preferred embodiment, the inner tank is coated with a ceramic paint for added insulation and the outer tank is treated with a fire resistant coating.

10 Claims, 3 Drawing Sheets

FIRE SUPPRESSION SYSTEM FOR A DOUBLE WALLED STORAGE TANK

BACKGROUND OF THE INVENTION

1. Field of the Invention

The present invention relates generally to the field of double walled storage tanks. More specifically, the present invention discloses an above-ground double walled storage tank having a spray apparatus fed by water circulated through the space between the inner and outer tanks for fire suppression.

2. Statement of the Problem

Double walled storage tanks are well known in the art for a wide variety of uses. In recent years, double walled tanks have increasingly been used for above ground storage of gasoline and other flammable liquids. This created a need for an effective means for fire suppression in such storage tanks. As will be discussed below, a number of prior art references teach that the temperature of the inner tank can be regulated by circulating a coolant, such as water, in the annular space between the tanks. However, none of these prior art references has apparently recognized that flooding the space between the tank with water can be entirely counterproductive if the inner tank has ruptured and is spilling gasoline or other flammable petroleum products into the space between the tanks. This situation merely tends to spread the blaze as the coolant is circulated out of the space.

A number of double walled storage tanks with temperature regulation systems or fire suppressions systems have been invented in the past, including the following:

| Inventor | U.S. Pat. No. | Issue Date |
|---|---|---|
| Majors | 4,993,497 | Feb. 19, 1991 |
| Gerhard | 4,756,447 | July 12, 1988 |
| Simon | 4,177,863 | Dec. 11, 1979 |
| DeBoer | 3,896,881 | July 29, 1975 |
| Powell | 3,019,843 | Feb. 6, 1962 |
| Bergstrom | 2,687,618 | Aug. 31, 1954 |
| Clark | 1,874,243 | Aug. 30, 1932 |
| Winkler | U.K. Appln. 2,000,022 | Filed 6/15/78 |

Majors discloses a deluge funnel tank jacket. A funnel shaped jacket is attached to a rib framing system that is strapped around the storage tank. In the event of fire, water is introduced at the top of the tank by the funnel and is then fed by gravity through the waterway formed between the funnel jacket and the tank shell.

Gerhard discloses a system using a fluid circulated in the jacket surrounding the inner tank to control temperature.

The Clark, Winkler, and Powell patents disclose double walled tanks that have an outer tank holding a fire suppressing liquid that is automatically released to control a fire in the inner storage tank.

Bergstrom discloses a storage system for liquefied hydrocarbons, such as propane or butane, in which a plurality of inner tanks are surrounded with water held in a single outer tank.

De Boer discloses an automatic fire extinguisher for a storage tank holding a flammable liquid. This system includes multiple reservoirs holding a fire extinguishing fluid that are activated at progressively higher temperatures to extend the time and quantity of fire extinguishing fluid available.

Simon discloses a safety liquid dispenser for holding a flammable liquid. A pressurized nonflammable gas, such as carbon dioxide, is held inside an intermediate container within the tank. The carbon dioxide can be selectively released into the tank to suppress any fire.

In addition to these prior art references, it should be noted that perhaps the most common method of fire fighting is to cool the exterior of the storage tank by spraying large quantities of water from a fire hose. However, the high pressure water hits the tank with such force that the water tends to immediately bounce back off the face of the tank. As a result, the water is in contact with the tank skin for only a short time and relatively inefficient in transferring heat because of this limited contact with the tank. Moreover, the fire fighter must position himself relatively closely to the tank and therefore exposes himself to increased peril.

3. Solution to the Problem

None of the prior art references uncovered in the search show a double walled storage tank having a spray apparatus fed by water circulated through the space between the inner and outer tanks. This circulation of water serves both to directly cool the inner tank by conductive heat transfer and to cool the entire assembly by the spray of water over the outer tank. In addition, the system includes a vapor sensor to detect leakage from the inner tank. In the event of leakage, the vapor sensor controls a valve in the outlet pipe that prevents flow to the spray apparatus, and instead directs the flow of coolant water and any entrained flammable liquid to a remote containment facility.

SUMMARY OF THE INVENTION

This invention provides a fire suppression system for a double walled storage tank having an inner tank for containing a flammable liquid and an outer tank separated from the inner tank by a defined space. A leakage detector monitors any leakage of the flammable liquid from the inner tank into the space. A temperature sensor triggers a flow of coolant into the space in the event combustion of the flammable liquid is detected. If no leakage of flammable liquid has been previously detected, the flow of coolant exits the space and is sprayed on the outer surface of the outer tank. If leakage has been detected, the coolant and any entrained flammable liquid are safety diverted to a remote location. In the preferred embodiment, the inner tank is coated with a ceramic paint for added insulation and the outer tank is treated with a fire resistant coating.

A primary object of the present invention is to provide an effective fire suppression system for a double walled storage tank.

Another object of the present invention is to provide a fire suppression system that can detect leakage of flammable liquid from the inner tank and automatically diverts the flow of coolant and entrained flammable liquid to a remote secondary containment.

Yet another object of the present invention is to provide a double walled storage tank with a fire suppression system capable of providing a two hour fire rating.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
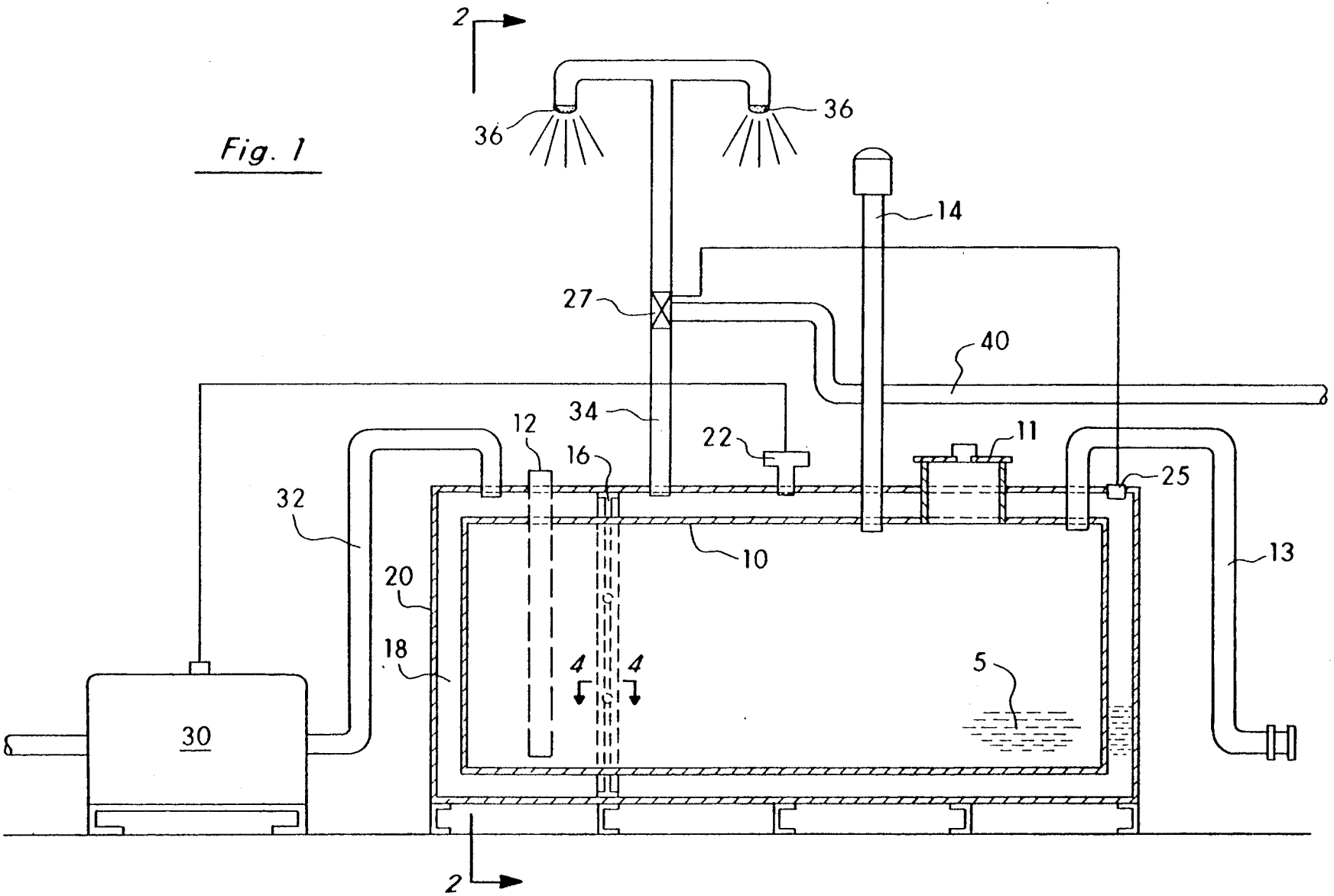
FIG. 1 is a vertical cross-sectional view taken along the length of the double walled storage tank.
Figure 2:
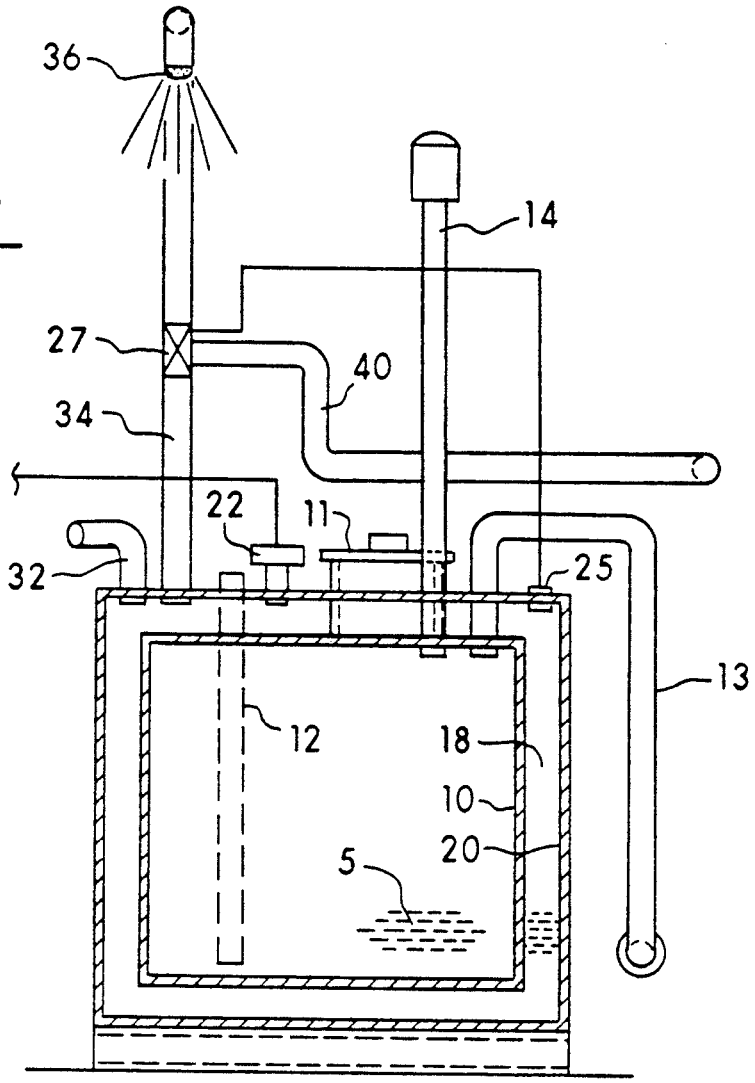
FIG. 2 is a vertical cross-sectional view taken across the width of the double walled storage tank taken along section line 2—2.

Turning to FIG. 1, the double walled tank assembly is shown in cross-section. The corresponding cross-sectional view of the double walled tank assembly taken across the width of the assembly is provided in FIG. 2.

The inner tank 10 is used to store a quantity of a flammable liquid 5, such as motor oil or the like. The details of the construction of the inner tank 10 are largely conventional. Liquid is introduced into the tank through a fill port 11 having a conventional clean-out and emergency pressure relief vent. A suction line 12 extends to a point near the bottom of the inner tank 10 to allow essentially all of the liquid stored in the inner tank to be removed, if necessary. An overfill pipe 13 is used to safely drain excess liquid from the inner tank 10 in the event of overflow. A second vent 14 runs from the inner tank 10 through the wall of the outer tank 20 for pressure equalization and to prevent accumulation of potentially explosive fumes within the inner tank 10. A conventional vent is approximately 1½ inches in diameter. The second vent 14 is oversized in the preferred embodiment to approximately three inches in diameter. This allows greater dissipation of fumes and also provides a slightly larger volume for thermal expansion before the liquid stored within the inner tank begins to flow out of the overfill pipe 13.

An outer tank 20 completely surrounds the inner tank 10. A space 18 is defined by the region separating the inner tank 10 from the outer tank 20. In the preferred embodiment, this space 18 completely encompasses the inner tank 10 so that the coolant can be circulated through the space to cool virtually the entire surface of the inner tank 10.

Figure 4:
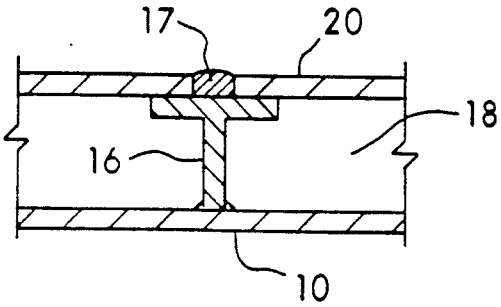
FIG. 4 is a fragmentary cross-sectional view of the double walled tank taken along section line 4—4 showing an example of one of the T bars used to support and separate the inner tank from the outer tank.

The details of construction of the T bars 16 separating the inner tank 10 from the outer tank 20 in the preferred embodiment are shown in cross-section in FIG. 4. The spacing between the tanks is approximately 2 inches in the preferred embodiment. Each T bar 16 is welded to the outer surface of the inner tank 10 by means of fillet welds extending along both sides of the bottom of the T bar. Each T bar 16 is also welded to the outer tank 20 by means of plug welds 17 through holes in the outer tank 20. It should be expressly understood that other types of spacers could be substituted for the T-bars 16 and that other means of fabrication could be employed.

A temperature sensor 22 monitors the temperature in the space 18 between the inner tank 10 and the outer tank 20. In the event the sensor 22 detects an elevated temperature indicative of combustion, the sensor 22 triggers a flow of coolant into the space 18. In the preferred embodiment, water is used as the coolant, although other coolants or fire suppressant materials, such as carbon dioxide, halide compounds, and the like could be substituted. The flow of water can be provided by a pump 30 as shown in FIG. 1, or can be provided by municipal water supply, fire hydrant, fire truck, elevated supply tank, and other equivalent water supply. The water flows through an inlet pipe 32 into the space 18, circulates through the space 18 to cool the inner tank 10, and then exits through an outlet pipe 34.

Figure 3:
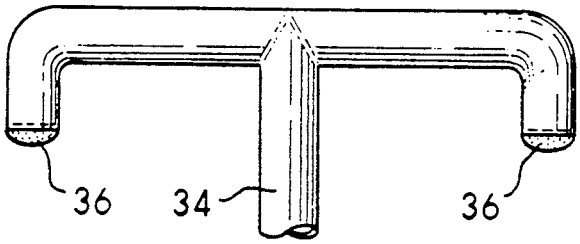
FIG. 3 is a fragmentary side view of the upper portion of the sprinkler assembly

FIG. 3 provides greater detail of the spray heads 36 at the upper end of the outlet pipe 34. The spray heads 36 cause the water exiting the double walled tank assembly to create a spray of droplets showering over the exterior of the outer tank 20. The additional cooling provided by the spray of coolant is normally very beneficial in suppressing and containing the fire. However, this is not the case if flammable liquid has escaped from the inner tank 10 into the intermediate space 18. In this event, flammable liquid is likely to become entrained with the flow of coolant leaving the intermediate space 18. The result could be disastrous if the mixture is then sprayed on the exterior of the outer tank.

This problem can be addressed by including a leak detector (e.g. a vapor sensor) 25 to detect the escape of any flammable liquid from the inner tank 10 into the intermediate space 18 between the tanks. This leak detector 25 controls a two-position valve 27 in the outlet pipe 34. In the event of fire, the flow of coolant is routed, as before, by the control valve 27 to the spray heads 36 if no leakage has been detected by the leak detector 25. Otherwise, if leakage has been detected, the flow of coolant is routed by the control valve 27 to a second pipe 40 leading to a remote containment facility, such as a secondary containment pond, located a substantial distance (e.g. approximately 50 feet) away from the double walled tank assembly.

Figure 5:
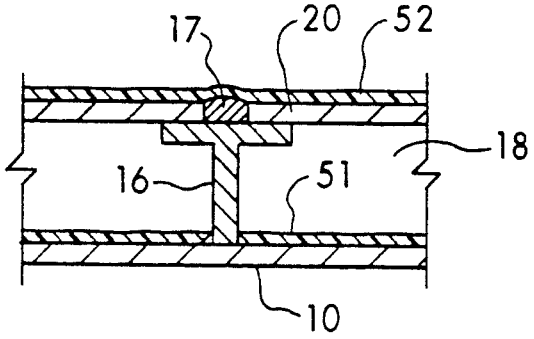
FIG. 5 is a fragmentary cross-sectional view similar to FIG. 4 of an alternative embodiment of the present invention in which the outer surface of the inner tank has been coated with a ceramic paint and the outer surface of the outer tank has been treated with a fire-resistant coating.

FIG. 5 demonstrates how the fire rating of the tank assembly can be substantially enhanced by coatings applied to the inner tank and/or the outer tank. For example, a ¼ to ⅝ inch epoxy intumescent-type coating 52, such as the "Chartek" coating available from Textron Corporation, can be applied to the exterior of the outer tank 20 to provide a fire rating of up to two hours. Brackets are attached to the outer surface of the outer tank around the fill port 11. A removable cover is then bolted to the brackets to enclose the clean-out and emergency pressure relief vent associated with the fill port 11 so that the Chartek coating does not foul these components.

In addition, a ceramic paint 51 can be applied to the outer surface of inner tank 10 (approximately 15 mils in thickness) for added insulation. The thermal properties of such ceramic paints are equivalent to several inches of conventional insulation. The ceramic paint also provides corrosion protection from condensation and the like within the space between the inner and outer tanks. For example, a suitable fluid-applied ceramic insulating paint is available under the brand name "ICC Ceramic System" from Insulating Coatings Corp. of Inverness, Florida.

The above disclosure sets forth a number of embodiments of the present invention. Other arrangements or embodiments, not precisely set forth, could be practiced under the teachings of the present invention and as set forth in the following claims.

I claim:

1. A fire suppression system for a double walled storage tank comprising:

an inner tank for containing a flammable liquid;

an outer tank having an outer surface and an inner surface separated from said inner tank by a defined space;

temperature sensing means for detecting combustion of said flammable liquid;

means controlled by said temperature sensing means for delivering a flow of coolant into said space in the event combustion of said flammable liquid is detected;

an outlet allowing said flow of coolant to exit said space through said outer tank;

spray means associated with said outlet for spraying said flow of coolant on said outer surface of said outer tank;

a sensor for detecting leakage of said flammable liquid from said inner tank into said space;

a pipe for directing said flow of coolant to a remote location; and a valve controlled by said sensor for either directing said flow of coolant to said spray means if not leakage of flammable liquid has been detected, or directing said flow of coolant to said remote location through said pipe if leakage of said flammable liquid has been detected.

2. The fire suppression system of claim 1, wherein said inner tank comprises a coating of ceramic paint.

3. The fire suppression system of claim 1, wherein said outer tank comprises a coating of fire resistant material.

4. The fire suppression system of claim 3, wherein said coating on said outer tank is comprised of a fire resistant epoxy intumescent-type coating.

5. A fire suppression system for a double walled storage tank comprising:

an inner tank for containing a flammable liquid;

an outer tank having an outer surface and an inner surface separated from said inner tank by a defined space;

temperature sensing means for detecting combustion of said flammable liquid;

means controlled by said temperature sensing means for delivering a flow of coolant into said space in the event combustion of said flammable liquid is detected;

a leakage sensor for detecting the escape of said flammable liquid from said inner tank into said space;

spray means for spraying said flow of coolant exiting said space on said outer surface of said outer tank if said leakage sensor has not detected flammable liquid escaping from said inner tank; and a pipe for carrying said flow of coolant exiting said space to a remote location if said leakage sensor has detected flammable liquid escaping from said inner tank.

6. The fire suppression system of claim 5, further comprising a valve controlled by said leakage sensor for either directing said flow of coolant to said spray means or to said remote location through said pipe.

7. The fire suppression system of claim 5, wherein said inner tank comprises a coating of ceramic paint.

8. The fire suppression system of claim 5, wherein said outer tank comprises a coating of fire resistant material.

9. The fire suppression system of claim 8, wherein said coating on said outer tank is comprised of a fire resistant epoxy intumescent-type coating.

10. A fire suppression system for a double walled storage tank comprising:

an inner tank for containing a flammable liquid having a coating of ceramic paint;

an outer tank having an outer surface treated with a coating of fire resistant material and an inner surface separated from said inner tank by a defined space;

temperature sensing means for detecting combustion of said flammable liquid;

means controlled by said temperature sensing means for delivering a flow of coolant into said space in the event combustion of said flammable liquid is detected;

a leakage sensor for the escape of said flammable liquid from said inner tank into said space;

an outlet allowing said flow of coolant to exit said space through said outer tank;

spray means for spraying said coolant on said outer surface of said outer tank;

a pipe for directing said flow of coolant to a remote location; and a valve controlled by said leakage sensor for either directing said flow of coolant exiting said outlet to said spray means if no leakage of flammable liquid has been detected, or directing said flow of coolant to said remote location through said pipe if leakage of said flammable liquid has been detected.

* * * * *